United States Patent [19]

Osawa et al.

[11] Patent Number: 4,653,387

[45] Date of Patent: Mar. 31, 1987

[54] METHOD OF OPERATING AN AIR-FEED TYPE SPRAY BOOTH

[75] Inventors: Michiaki Osawa, Nagoya; Hidetoshi Omori, Toyota; Hidemasa Inoue, Feto, all of Japan

[73] Assignee: Trinity Industrial Corporation, Tokyo, Japan

[21] Appl. No.: 789,769

[22] Filed: Oct. 21, 1985

[30] Foreign Application Priority Data

Mar. 29, 1985 [JP] Japan ..... 50-63961
Mar. 29, 1985 [JP] Japan ..... 50-63962

[51] Int. Cl.[4] ..... B05C 15/00
[52] U.S. Cl. ..... 98/115.2
[58] Field of Search ..... 98/115.1, 115.2, 115.3

[56] References Cited

U.S. PATENT DOCUMENTS 3,518,814 7/1970 Maynard ..... 98/115.1 X
4,261,256 4/1981 Jorey ..... 98/115.2
4,548,128 10/1985 Morikawa et al. ..... 98/115.3

*Primary Examiner*—Harold Joyce
*Attorney, Agent, or Firm*—Cushman, Darby & Cushman

[57] ABSTRACT

A method of operating an air-feed type spray booth, which comprises forcively feeding an air from an air conditioner to the inside of a spray booth by a feed fan, drawing the air in the spray booth together with painting mists, or the likes by an exhaust fan through the floor of the booth and then exhausting them externally, while the direction of air streams, if any, flowing inwardly and/or outwardly of the booth through the inlet and/or outlet thereof is detected and the exhaust flow rate of the exhaust fan and/or the feed flow rate of the feed fan is variably controlled depending on the detected direction of the air streams, so as to inhibit the air stream from flowing inwardly and/or outwardly throught inlet and/or outlet.

5 Claims, 6 Drawing Figures

FIG. 5
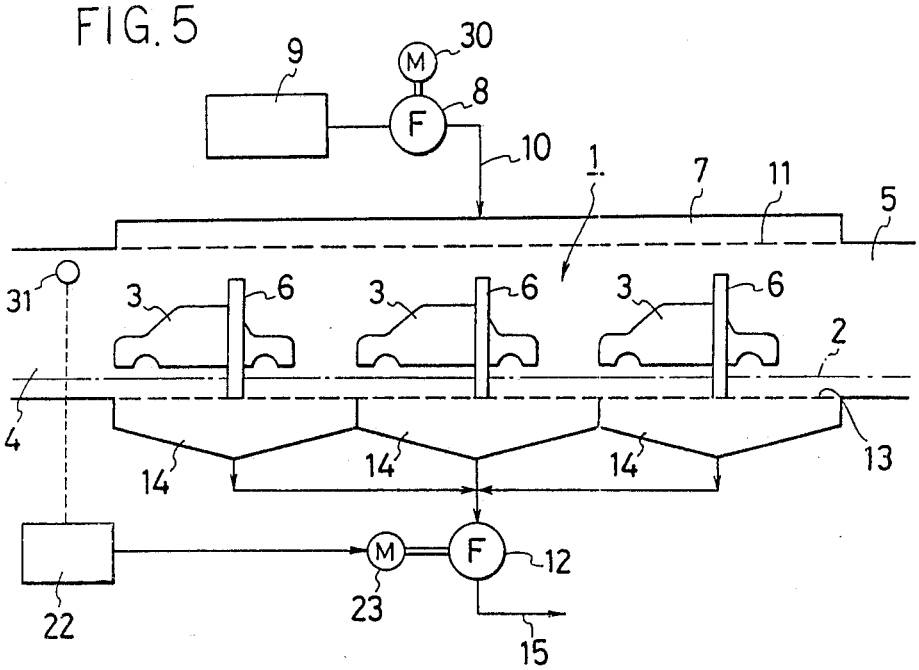
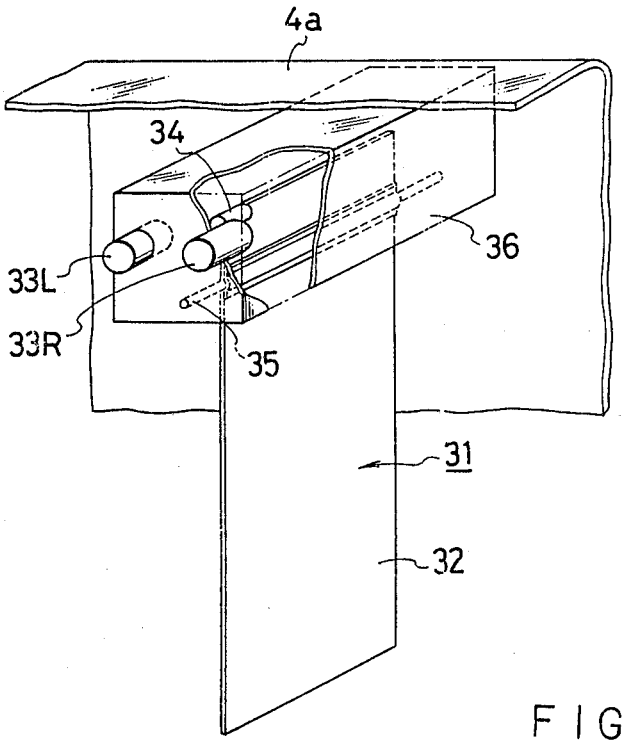
FIG. 6

METHOD OF OPERATING AN AIR-FEED TYPE SPRAY BOOTH

BACKGROUND OF THE INVENTION

1. Field of the Invention

The present invention concerns a method of operating an air-feed type spray booth and, more specifically, it relates to a method of operating an air-feed type spray booth, disposed to a coating line, having a tunnel-like booth through which articles to be spray-coated such as car bodies are successively conveyed and in which an air supplied from an air conditioner to a plenum chamber is forcively fed by a feed fan downwardly at a predetermined speed and then drawn together with painting mists, evaporated vapors of organic solvents, etc. entrained thereon down through the floor of the booth by an exhaust fan.

2. Description of the Prior Art

An air-feed type spray booth, for example, for applying spray coating on car bodies is usually disposed between a device for applying pre-treatment to the spray coating and a device for applying post-treatment such as a drying furnace in a coating line, along which the car bodies to be spray coated are successively passed on a conveyor. The spray booth has an elongate tunnel-like configuration in which a clean conditioned air supplied by a feed fan to the plenum chamber is forcively fed downwardly at a predetermined speed and then the air, after picking-up painting mists and vapors of organic solvents resulted from spray coating, is drawn downwardly through the floor of the booth by an exhaust fan, so as to suppress the scattering of the painting mists, dusts, etc. that would otherwise give undesired effects on the coated films thereby keeping the coating quality satisfactorily, as well as maintaining the working circumstance healthy where operators conduct preparation for the automatic coating or conduct spray coating manually in the spray booth.

In the air-feed type spray booth of the aforementioned structure, if the flow rate of the air fed from the air conditioner by the feed fan to the plenum chamber is different from the flow rate of the air drawn and exhausted down through the floor of the booth, external airs, for example, from the pre-treatment device or the drying furnace that contain dusts and the likes or are at an undesirably high temperature would intrude through the inlet or outlet opened at both ends of the booth to degrade the coating quality of the coated articles, or airs contaminated with the painting mists, solvent vapors, etc. are issued externally from the inside of the booth through the inlet or outlet to the pre-treatment device of the drying furnace to worsen the working conditions therein.

As the countermeasure for the foregoing disadvantages, the feed fan and the exhaust fan have heretofore been driven each at a predetermined constant number of rotation such that the flow rates are identical between the feeding air and the exhaust air thereby inhibiting the air streams from flowing inwardly and/or outwardly of the spray booth through the inlet and/or outlet thereof to the devices at the upstream and downstream.

However, in the air-feed type spray booth usually adapted to draw and exhaust the air through a plurality of sucking ports formed as the slits in the floor of the booth to the beneath of the floor, spray coated articles such as car bodies are successively conveyed on the floor of the booth, while closing or exposing the sucking ports as they move continuously through the booth. Accordingly, the open area of the sucking ports and thus the flow rate of the exhaust escaping through the ports vary depending on the number of the interval of the car bodies conveyed on the floor of the booth.

Then, even if the number of rotation for the feed fan and the exhaust fan is set to a certain level as in the prior art, the balance between the flow rates of the feed and exhaust airs may be lost depending on the manner that the car bodies, etc. are conveyed through the spray booth.

Further, below the floor of the spray booth, there is disposed a mist treating chamber comprising a venturi device for separating to remove the painting mists by the gas-liquid contact of the drawn exhaust air with water therein and a water tank for recoverying water supplied to the venturi device.

Then, if the amount of water supplied to the venturi device or the amount of water stored in the water tank changes, the working load imposed on the exhaust fan varies to possibly fluctuate the number of rotation thereof and break the balance between the feed air and the exhaust air. Imbalance between the flow rate of the feed air and that of the exhaust air leads to various disadvantages as described above. Specifically, if the flow rate of the exhaust air is predominant, liquid chemicals such as a processing liquid for chemical formation for the pre-treatment device upstream to the spray booth or a hot air stream at a high temperature of about 150°-200° C. from the drying furnace downstream to the spray booth may be flown to the inside of the booth, thereby deteriorating the working circumstance in the spray booth or degrading the coating quality. On the other hand, if the feed air is predominant, it causes the air in the spray booth usually conditioned to about 25° C. to be released in a great amount and flow into the downstream drying furnace, which may possibly lower the temperature in the furnace suddenly, thereby, result in defective baking, etc.

However, there have been known no effective countermeasure for such disadvantages of the air-feed type spray booth in the prior art.

OBJECT OF THE INVENTION

It is, accordingly, an object of the present invention to provide a method of operating an air-feed type spray booth capable of rapidly and automatically detecting the air streams flowing inwardly and/or outwardly of a spray booth through the inlet and/or outlet thereof caused by the imbalance between the flow rate of an air fed by a feed fan into the spray booth and the flow rate of an air exhausted by an exhaust fan out of the spray booth, thereby preventing the air streams from flowing inwardly and/or outwardly of the spray booth through the inlet and/or outlet thereof.

SUMMARY OF THE INVENTION

The foregoing objects of the present invention can be attained by a method of operating an air-feed type spray booth, which comprises forcively feeding an air from an air conditioner through a plenum chamber to the inside of a tunnel-like spray booth by a feed fan, drawing the air in the spray booth together with painting mists, evaporated vapors of organic solvents or the likes by an exhaust fan through the floor of the booth and then exhausting them externally, while the direction of air streams, if any, flowing inwardly and/or outwardly of the booth through the inlet and/or outlet disposed at the extreme ends of the booth is detected and the exhaust flow rate of said exhaust fan and/or the feed flow rate of the feed fan is variablly controlled depending on the detected direction of the air streams, so as to inhibit the air streams from flowing inwardly and/or outwardly through the inlet and/or outlet.

In accordance with the method of the present invention, if it is detected that the air stream flows outwardly of the spray booth through the inlet and/or outlet thereof, the flow rate of the exhaust is increased to a predetermined value, for example, by increasing the number of rotation for the exhaust fan, varying the angle of the rotary vane thereof, etc. of the flow rate of the feed air is decreased by lowering the number of rotation for the feed fan, so that the air in the spray booth is inhibited from flowing outwardly, for example, to the downstream drying furnace in communication with the booth, whereby the disadvantage such as lowering of the baking temperature in the furnace can be eliminated.

On the other hand, if it is detected that the air stream flows inwardly of the spray booth through the inlet and/or outlet thereof, the flow rate of the exhaust fan is decreased or the flow rate of the feed air is increased to a predetermined value, so that the air in the spray booth is inhibited from flowing inwardly, for example, from the upstream pre-treatment device in communication with the booth, whereby the disadvantage such as intrusion of chemical-contaminated liquid that would otherwise give undesired effects on the coating quality into the spray booth can be eliminated.

DESCRIPTION OF THE ACCOMPANYING DRAWINGS

These and other objects, features as well as advantageous effects of the present invention will be made clearer by the description for preferred embodiments thereof while referring to the accompanying drawings, wherein FIG. 1 is a schematic view illustrating one embodiment for practicing the method of the present invention;

FIG. 5 is a schematic view illustrating another embodiment for practicing the method of the present invention; and FIG. 6 is a perspective view showing another embodiment of the flow detector for use in the present invention.

DESCRIPTION OF PREFERRED EMBODIMENTS

Figure 1:
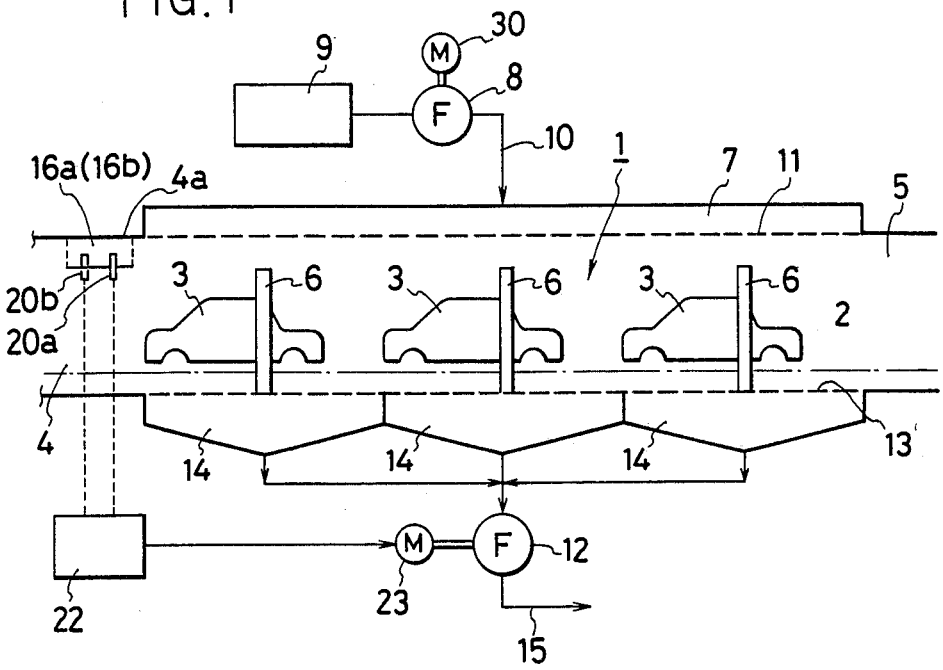

The present invention will now be described specifically referring to preferred embodiments shown in the drawings.

FIG. 1 shows a schematic view of one embodiment for practicing the method according to the present invention.

In the figure, a spray booth 1 of a tunnel-like configuration in which a flow conveyor 2 successively conveys car bodies, 3, 3,—therethrough for spray coating. The spray booth 1 is opened at an inlet 4 and an outlet 5 which are connected to a pre-treatment device at the preceeding stage and to the drying furnace at the subsequent stage (not illustrated) to a spray booth 1 respectively.

The spray booth 1 has a plurality of automatic coaters 6 disposed to its inside at an interval of about 20 m and a plenum chamber 7 disposed at the ceiling thereof. A feed fan 8 forcibly feeds air supplied from an air conditioner 9 to the plenum chamber 7 into the spray booth 1 by way of a feed duct 10 and through a filter 11.

The conditioned clean air enforced to the inside of the spray booth is caused to flow downwardly at a uniform speed of about 0.2–0.5 m/sec and then drawn to suck together with coating mists and evaporated vapors of organic solvents, etc. resulted in the spray booth 1 into a mist treating chamber 14 below the floor 13 by an exhaust fan 12. Then, the drawn air is brought into a gas-liquid contact in the mist treating chamber 4 and, after being separated from the coating mists, is exhausted externally through an exhaust duct 15.

At the inlet 4 of the spray booth 1, are disposed a pair of anemometers (flow meters) 16*a* and 16*b* for detecting the direction and the speed of air streams flowing inwardly and/or outwardly of the inlet 4 at the ceiling portion.

Figure 2:
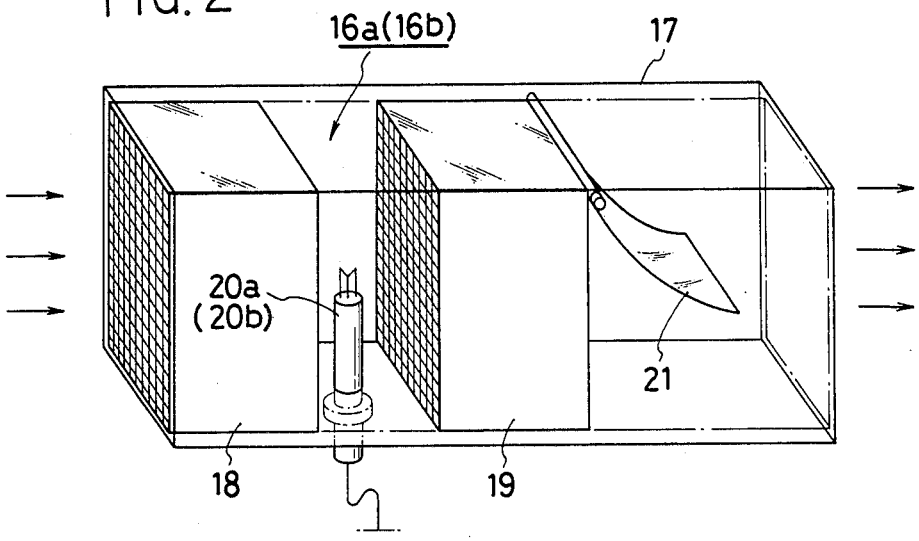
FIG. 2 is a schematic perspective view illustrating one embodiment of a flow detector for use in the present invention.

The anemometer 16*a* has a structure for example, as shown in FIG. 2, in which flow rectifiers 18 and 19 each of a honeycomb configuration are disposed with a predetermined interval in a square cylindrical vessel 17, for example, made of a transparent acrylic resin, and a hot-wire type flow sensor 20*a* (20*b*) is disposed between the flow rectifiers 18, 19. In the case of the flow sensor 20*a*, an aluminum foil sheet 21 is appended on one side of the flow rectifier 19 opposing to the side of the flow sensor 20*a* so as to be swingeable at its upper pivotal axis.

In a case where air streams flow from the side of the flow rectifier 18 into the cylindrical vessel 17 (along the arrow shown in FIG. 2), the air streams are allowed to pass through the rectifiers 18 and 19 while fluttering the aluminum foil sheet 21 and actuating the flow sensor 20*a* in the course of the passage. While on the other hand, if the air streams flow out of the cylindrical vessel 17 (in the direction opposite to the arrow shown in FIG. 2), the aluminum foil sheet 21 is brought into contact with the surface (on the right side in FIG. 2) of the flow rectifier 19 to inhibit the passage of the air streams through the cylindrical vessel 17, whereby the flow sensor 20*a* remains not-actuated.

Another anemometer 16*b* has the similar structure to that of the anemometer 16*a* excepting that the structure is upset with respect to the direction of the stream line, that is, the aluminum foil sheet is appended on the side (left side) of the flow rectifier 18 such that the air streams are allowed to pass through the cylindrical vessel 17 only in the direction opposite to the arrow in FIG. 2. Accordingly, the flow sensor 20*a* of the anemometer 16*a* issues a detection signal only when the air streams enter into the spray booth 1 through the inlet 4 to detect the flow speed of the air streams. While on the other hand, the flow sensor 20*b* of the anemometer 16*b* (not shown) issues a detection signal only when the air streams leaves the spray booth 1 through the inlet 4. Thus, the flowing direction of the air streams at the inlet 4 of the spray booth 1 can be detected, together with the flow rate into and out of the inlet 4, depending on whether the detection signals are issued from the flow sensor 20*a* or 20*b*.

In this embodiment, the flow sensor 20*a* (20*b*) is a hot-wire type anemometer that converts the change in the resistance of the hot-wire exposed to the air streams into that of the voltage and issues the voltage change as a detection signal to the control device 22. The control device 22 scans the inputted detection signals on every predetermined time and issues a control signal that controls, by way of an inverter, the number of rotation for a stepless speed change motor 23 driving the exhaust fan 12 based on the average value for the flow speed of the air streams determined on the input data, by which the flow rate of the exhaust air discharged from the inside of the spray booth through the exhaust duct 15 is adjusted to maintain the balance between the flow rate of the air fed from the feed fan 8 to the inside of the spray booth 1 and the flow rate of the exhaust air discharged out of the booth 1 by the exhaust fan 12, thereby suppressing the air stream from flowing into and out of the inlet 4 and the outlet 5.

Figure 3:
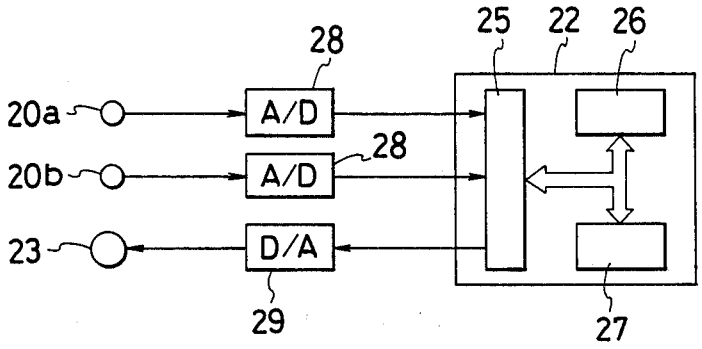
FIG. 3 is a block diagram illustrating one embodiment of a control device for use in the present invention.

The control device 22 is constituted in this embodiment, for example, as a portion of a microcomputer as shown in FIG. 3, which comprises at least an interface circuit 25, a mathematical processor 26 and a memory unit 27.

The interface circuit 25 has A/D converters 28, 28 at the input thereof for connection with hot-wire type flow sensors 20*a* and 20*b* for detecting the flow speed of the air streams at the inlet 4 of the spray booth 1, as well as a D/A converter 29 at the output thereof in connection with a motor 23 for the exhaust fan 12.

The mathematical processor 26 is adapted to perform predetermined mathematical operations upon reading detection signals from the flow speed sensors 20*a* and 20*b* thereby deliverying a control signal for controlling the number of rotation of the motor 23.

The memory unit 27 stores a predetermined program for performing the mathematical operation in the mathematical processor 26, together with various data required for such operation.

Figure 4:
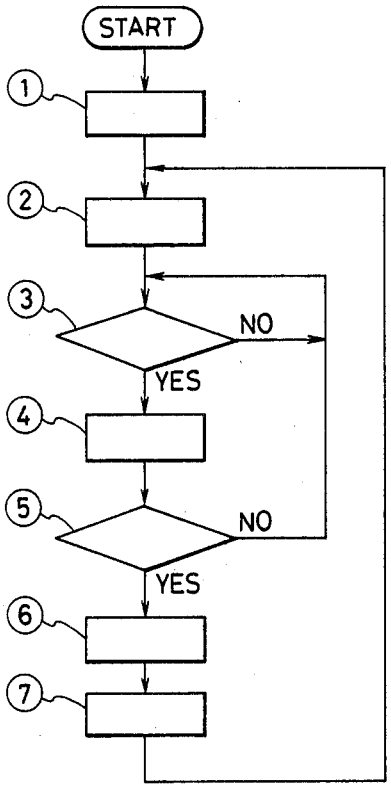
FIG. 4 is a flow chart showing the processing steps performed by the control device.

FIG. 4 is a flow chart showing the processing steps performed in the mathematical processor 26.

Briefly speaking to the flow chart, upon inputting the number of rotation N for the motor 30 that drives the feed fan 11 at a predetermined feed flow rate such that the air fed from the air conditioner 9 to the plenum chamber 7 is caused to flow downwardly into the spray booth 1 at a predetermined flow speed at the step (1), the number of rotation n for the motor 23 of the exhaust fan 12 is set corresponding to the number of rotation N. Then, a control signal corresponding to the number of rotation n is outputted to the motor 23 at the step (2) to drive the motor 23 at the number of rotation n.

Then, the program is proceeded to the step (3) and kept to standy-by till a predetermined of time (for example, 10 second) is elapsed. The step (3) is proceeded to the step (4) on every elapse of 10 seconds at which detection signals from the flow speed sensors 20*a*, 20*b* are inputted.

The detection signals are stored as positive or negative values into predetermined memory areas of the memory unit 27 depending on whether the detection signals are issued from the flow speed sensor 20*a* or the 20*b*. That is, a positive detection value is stored when the air streams flow outwardly of the inlet 4 and a negative detection value is stored when the air streams flow inwardly of the inlet 4.

Then the program is proceeded to the step (5) where it is judged if a certain period of time, for example, 2.5 minutes has been elapsed from the time of issuing the control signal. If the time has not yet elapsed, the program returns to the step (3) and continues to perform the operation for the input detection signals till the elapse of 2.5 minutes. If 2.5 minutes have elapsed, the program proceeds to the step (6) where the increment or decrement dn in the number of rotations for the motor 23 is determined depending on the data of the flow speed inputted at the step (4).

At the step (6), the flow speeds of the air streams inputted on every 10 second intervals included within a period from the output of the control signal till the elapse of 2.5 minutes are at first averaged to determine an average value V during this period.

Assuming the opening area as A for both of the inlet 4 and the outlet 5, since the average flow speed at the outlet 5 is also considered as V, the air flow rate to be increased or decreased can approximately be determined as 2 AV.

Further, assuming increment or decrement in the number of rotation for the motor 23 as dn, the flow rate to be changed by increment or decrement dn in the number of rotation as dQ and the present flow rate as Q, there is established a relationship:

$$dn/n = dQ/Q.$$

Since the flow rate Q is given as a function f(n) of the number of rotation n and change of the flow rate can be given as: $dQ=2AV$, the increment or decrement dn in the number of rotation can be determined by the following equation:

$$dn = 2AV\, n/f(n).$$

The equation described above is only an example for simply calculating the increment or decrement dn in the number of rotation and this invention is no way limited thereto.

Then, the program is proceeded to the step (7) where the increment or decrement dn in the number of rotation calculated at the step (6) is added to the present number of rotation n of the motor 23 to replace the number of rotation as $n' = n + dn$. Then, the program returns to the step (2) where a control signal corresponding to the number of rotation n' is issued.

In this case, if the streams of contaminated air in the spray booth 1 tend to flow outwardly of the inlet 4, that is, if the average flow speed is calculated as: $V>0$, dn in the number of rotation is determined as: $dn>0$ and the number of rotation for the motor 23 is increased. While on the other hand, if external air streams tend to flow inwardly of the inlet 4 into the spray booth 1, that is, if the average flow speed is calculated as: $V<0$, dn in the number of rotation is determined as: $dn<0$ and the number of rotation for the motor 23 is decreased. Further, in a case where the air streams flow neither outwardly nor inwardly, that is, where the average flow speed is calculated as: $V=0$, dn in the number of rotation is determined as: $dn=0$, and the number of rotation for the motor 23 is maintained as it is.

The method of operating the spray booth in accordance with this invention will now be described more specifically.

At first, the motors 23 and 30 are started each being set to a predetermined number of rotation. For instance, clean air from the air conditioner 9 is fed by the feed fan 8 to the inside of the spray booth 1 of 6 m width and 50 m length at a rate of about 7000 $m^3$/min, while the exhaust air is discharged at the same flow rate out of the coating booth 1 by the exhaust fan 12. The direction and the speed of the air streams at the inlet 4 are measured on every 10 second intervals by the anemometers 16*a* and 16*b* (refer to the steps (1)-(4)).

Then, when the car bodies 3, 3,—are successively conveyed through the spray booth 1 carried on the floor conveyor 2, the suction ports formed on the floor surface 13 for drawing the air in the spray booth 1 are partially closed by the car bodies 3, 3,—passing thereover, by which the flow resistance is increased to impose a larger load on the exhaust fan 12 thereby relatively decrease the total exhaust flow rate. As a result, the air in the spray booth 1 flows externally through the inlet 4 and the outlet 5. Thus, the air streams flow outwardly of the inlet 4 passing through the cylindrical vessel 17 containing the anemometer 16*a* and the flow speed of the air streams is detected by the flow sensor 20*a* on every 10 seconds and the detected values are stored in the memory unit 27 of the control device 22 (step (4)).

Then, after the elapse of a certain period of time (2.5 minutes), the date for the flow speed detected therein are averaged to calculate an average flow speed V, based on which the increment dn in the number of rotation is calculated (steps (5), (6)). Then, the calculated increment dn in the number of rotation is added to the number of rotation n so far to replace it with a new number of rotation n′ (step (7)), and a control signal corresponding to the number of rotation n′ is issued to increase the number of rotation for the motor 23 (step (2)).

In this way, when the number of rotation for the motor 23 that drives the exhaust fan 12 is increased, the flow rate of the exhaust discharged from the spray booth 1 through the exhaust duct 15 is increased to be equalized with the flow rate of the air fed from the feed fan 8, whereby the spray booth 1 is maintained approximately to such a state where the air streams flow neither inwardly nor outwardly through the inlet 4 and the outlet 5.

On the other hand, if the number of car bodies 3, 3,—to be conveyed is decreased from the above-mentioned state, the opening area of the sucking ports in the floor 13 covered so far by the car bodies 3,3,—is exposed to moderate the load on the exhaust fan 13. As a result, the flow rate of the exhaust is relatively increased causing the external air streams to flow inwardly through the inlet 4 and the outlet 5 into the spray booth 1.

In this case, the flow of the air streams to the cylindrical vessel 17 containing the anemometer 16*a* is inhibited by the aluminum foil sheet 21 now closing the upstream side (righthand of the flow rectifier 19) and the air streams flow only through the cylindrical vessel 17 containing the other anemometer 16*b*. In this case, the flow speed of the air streams is detected only by the flow sensor 20*b* and the detection signals therefrom are stored as negative values to the memory unit 27. Thereafter, the decrement dn in the number of rotation is determined in the same procedures as described above and a control signal is issued so as to reduce the number of rotation for the motor 23.

Then, when the number of rotation for the motor 23 is decreased, the flow rate of the exhaust discharged externally from the spray booth 1 through the exhaust duct 15 is decreased to be equalized with the flow rate of the air fed from the air conditioner by the feed fan 8 to inhibit the air streams so far flowing inwardly to the spray booth 1.

In this way, the flow rate for the exhaust is automatically controlled such that neither the external airs containing undesirable dusts or the likes flow into the spray booth 1 nor the contaminated air streams flows externally.

Although the control means have been described as above, this invention is no way limited only thereto.

FIG. 5 shows a schematic view for illustrating another embodiment practicing the method of the present invention, and FIG. 6 is a perspective view illustrating another embodiment of the anemometer used therefor. Similar portions to those shown in FIG. 1 carry the same reference numerals, for which detailed explanations are omitted.

In these figures, a single anemometer 31 is disposed for detecting the direction of the air streams at the inlet 4 of the spray booth 1, which detects the air streams flowing inwardly and/or outwardly through the inlet 4 and issues various modes of detection signals to the control device 22 depending on the directions of the air streams such as, for example, "01" when the air streams are outgoing, "10" when the air streams are inflowing and "00" when there are no air streams.

The anemometer 31 comprises a light weight swing plate 32 made of a synthetic resin or the like that swings depending on the air streams and proximate switches 33R and 33L for detecting the swinging state of the swing plate 32, which is secured at the ceiling 4*a* of the inlet 4.

The swing plate 32 has a magnetic member 34 secured at the upper end thereof and a pivotal shaft 35 disposed in parallel with the upper edge of the plate 32. The pivotal shaft 35 is supported horizontally at the both ends thereof horizontally to a box-like casing 36 opened at the bottom.

Specifically, the swing plate 32 is suspended with a portion below the pivotal shaft 35 being exposed from the casing 36 such that it may be swung by the air streams thereby causing the magnetic member 34 secured at the upper end of the plate 32 to swing correspondingly.

The proximate switches 33R and 33L are disposed on the side of the casing 36 along an arc traced by the movement of the magnetic member 34 around the pivotal shaft 35 as a center and in a symmetrical relationship with respect to the right and left at a certain interval. When the magnetic member 34 comes closer to either of the switches 33R and 33L, the direction of the air streams is detected.

That is, when there are no air streams, the swing plate 32 suspends vertically to situate the magnetic member 34 at the center between both of the proximate switches 33R and 33L, by which both of the switches 33R and 33L are kept OFF to issue "00" as detection signals.

Then, if air streams flow from the left to the right in FIG. 6 (flowing inwardly through the inlet 4), the swing plate 32 is tilted to displace the magnetic member 34 leftwardly to turn only the proximate switch 33L on the left to ON, by which "10" is issued as the detection signal.

On the contrary, if air streams flow from the right to the left in FIG. 6 (flowing outwardly through the) inlet 4), the swing plate 32 is tilted oppositely to displace the magnetic member 34 to the right, by which only the proximate switch 33R on the right is turned ON to issue "01" as the detection signal.

The control device 22 receives the detection signals as input from the anemometer 31 on every predetermined time intervals (for example, 2.5 minutes) intermittently, to issue a control signal that variablly controls the number of rotations for the motor 23 of the exhaust fan 12 stepwise based on the inputted detection signals. If the air streams are judged to flow outwardly, the number of rotation n for the motor 23 is increased by a previously determined increment dn. While on the other hand, if the air streams are judged to flow inwardly the number of rotations n for the motor 23 is decreased by a predetermined decrement dn.

In this way, by varying the number of rotations for the motor 23 stepwise depending on the detection signals from the anemometer 31 inputted on every predetermined time intervals, the flow rate of the exhaust discharged by the exhaust fan 12 is increased or decreased to maintain the balance between the feed flow rate and the exhaust flow rate, whereby the air streams are inhibited from flowing inwardly or outwardly through the inlet 3 and the outlet 5.

Although the anemometers **16*a*, 16*b* (as well as 31) are disposed only at the inlet 4 to detect the direction and the speed of the air streams there in the foregoing embodiment, this invention is no way limited to such an arrangement but the anemometer may be disposed to both of the inlet 4 and the outlet 5, so as to detect the direction and the flow rate of the air streams through both of them. In this case, if the flow speed is different between the inlet 4 and the outlet 5**, the average flow speed between them is determined and the average flow speed may be used for the control.

Further, a plurality paires of anemometers **16*a* and 16*b* may be disposed being distributed over the opening area of the inlet 4 to determine the average values therefrom for the control. In this case, the flow speed at the inlet 4** can be detected more exactly.

Further, various optional means may be employed for detecting the direction of the air streams at the inlet 4 not being restricted only to the anemometers **16, 16*b* using the hot-wire type flow sensors 20*a*,20*b* or anemometer 31 using the swing plate 32**.

Furthermore, although the flow rate for the exhaust is variablly controlled in the foregoing embodiment by the control for the number of the rotation for the motor 23 of the exhaust fan 12, the present invention is no way limited only thereto. For example, the exhaust flow rate from the exhaust fan 12 can also be adjusted by varying the angle of the rotary vane in the case of an exhaust fan 12 of a propellar type, or by varying the angle of a flow rate control damper disposed to the exhaust duct 15 by a stepwise operating motor or the like.

Furthermore, the present invention is not restricted only to the variable control for the exhaust flow rate from the exhaust fan 12 but the feed flow rate from the feed fan 8, or both of the exhaust flow rate and the feed flow rate from the exhaust fan 12 and the feed fan 8 may be controlled variably.

As described above, according to this invention, since the direction of the air streams flowing inwardly and/or outwardly through the inlet and/or outlet opened at both ends of the spray booth are detected, and the exhaust flow rate from the exhaust fan and/or the feed flow rate from the feed fan are variably controlled depending on the detected direction of air streams such that the air streams are inhibited from flowing neither inwardly nor outwardly through the inlet and the outlet, if the balance between the exhaust flow rate and the free flow rate is lost by some reasons causing the air streams to flow inwardly and/or outwardly of the spray booth, the exhaust and/or feed flow rate is instantly increased or decreased to recover the balance between both of the flow rates, whereby defective spray coating caused by the inward flowing of external airs containing dusts or the likes from the pre-treatment device or hot air streams from the drying furnace, or defective baking in the drying furance caused by the outward flowing of the contaminated air in the spray booth can be prevented.

What is claimed is:

1. A method of operating an air-feed type spray booth, which comprises:

forcibly feeding air from an air conditioner through a plenum chamber to the inside of a tunnel-like spray booth by a feed fan;

drawing the air in said spray booth together with painting mists, evaporating vapors of organic solvents or the like by an exhaust fan through the floor of said booth and then exhausting them externally, while the air streams, if any are flowing in at least one of the inward and outward directions relative to said booth through at least one of the inlet and the outlet disposed at the extreme ends of said booth where the air streams, if any, are detected; and, variably controlling at least one of the exhaust flow rate of said exhaust fan and the feed flow rate of said feed fan depending on the detected direction of the air streams, so as to inhibit the air streams from flowing in at least one of the inward and outward directions relative to said booth through at least one of said inlet and outlet.

2. The method of operating an air-feed type spray booth as defined in claim 1, wherein the direction of the air streams flowing through at least one of the inlet and outlet is detected on every predetermined time interval, thereby permitting intermittent adjustment of at least one of the exhaust flow rate of the exhaust fan and the feed flow rate of the feed fan.

3. The method of operating an air-feed type spray booth as defined in claim 1, including detecting the directions and the flow speeds of the air streams flowing through at least one of the inlet and outlet continuously for a predetermined period of time to determine an average value for said flow speed, and stepwise adjusting at least one of the exhaust flow rate and the exhaust fan and the feed flow rate of the feed fan in accordance with said average value.

4. The method of operating an air feed type spray booth as defined in claim 1 including variably controlling the exhaust flow rate of the exhaust fan depending on the detected direction of the air streams.

5. The method of operating an air feed type spray booth as defined in claim 1 including disposing the spray booth between a device for applying pre-treatment to the spray coating and a device for applying post-treatment to the spray coating, which are arranged while being communicated one by one successively along the coating line.

* * * * *